US006949036B2

(12) United States Patent
Ciesar et al.

(10) Patent No.: US 6,949,036 B2
(45) Date of Patent: Sep. 27, 2005

(54) BATTING SWING TRAINER AND METHOD

(75) Inventors: John G. Ciesar, Justice, IL (US); James W. Kendall, Mt. Prospect, IL (US); Scott A. Massing, Chicago, IL (US)

(73) Assignee: Baseball Marketing Ideas, L.L.C., Justice, IL (US)

( * ) Notice: Subject to any disclaimer, the term of this patent is extended or adjusted under 35 U.S.C. 154(b) by 17 days.

(21) Appl. No.: 09/882,627

(22) Filed: Jun. 15, 2001

(65) Prior Publication Data

US 2002/0055402 A1 May 9, 2002

Related U.S. Application Data

(60) Provisional application No. 60/246,465, filed on Nov. 7, 2000.

(51) Int. Cl.[7] ..... A63B 69/00

(52) U.S. Cl. ..... 473/457; 473/564; 473/568

(58) Field of Search ..... 473/422, 457, 473/564–568, 437, FOR 166, 169, 170; 482/49, 50

(56) References Cited

U.S. PATENT DOCUMENTS

| | | | | | |
|---|---|---|---|---|---|
| 2,091,458 | A | | 8/1937 | Sleighy | |
| 3,030,837 | A | * | 4/1962 | Chartier | D8/51 |
| 3,116,926 | A | * | 1/1964 | Owen et al. | 473/457 |
| 3,136,546 | A | | 6/1964 | Connolly | |
| 3,946,518 | A | * | 3/1976 | Ylitalo | 446/266 |
| 3,955,816 | A | * | 5/1976 | Bratt | D21/758 |
| 4,017,070 | A | | 4/1977 | Hilton | |
| 4,317,567 | A | * | 3/1982 | Blake | 473/463 |
| 4,377,125 | A | * | 3/1983 | Westfall | 473/234 |
| 4,399,996 | A | | 8/1983 | Boyce | |
| 4,444,396 | A | * | 4/1984 | Wendt | 473/242 |
| 4,555,111 | A | * | 11/1985 | Alvarez | 473/457 |
| 4,634,121 | A | * | 1/1987 | Sasaki | 473/457 |
| 4,671,508 | A | * | 6/1987 | Tetreault | 473/457 |
| 4,898,386 | A | * | 2/1990 | Anderson | 473/457 |
| 5,011,145 | A | * | 4/1991 | Bartkowicz | 473/568 |
| 5,014,984 | A | | 5/1991 | Brockhoff | |
| D339,621 | S | * | 9/1993 | Briden | D21/725 |
| 5,277,421 | A | * | 1/1994 | Rewolinski | 473/256 |
| 5,303,917 | A | * | 4/1994 | Uke | 473/567 |
| 5,312,308 | A | * | 5/1994 | Hamilton et al. | 473/256 |
| 5,360,209 | A | * | 11/1994 | Mollica | 473/457 |
| 5,460,378 | A | | 10/1995 | Getts | |
| 5,577,966 | A | | 11/1996 | Duran | |
| 5,839,983 | A | * | 11/1998 | Kramer | 473/568 |
| 6,050,908 | A | * | 4/2000 | Muhlhausen | 473/457 |
| 6,254,498 | B1 | | 7/2001 | Tyner | |
| D457,929 | S | * | 5/2002 | Ciesar et al. | D21/725 |

FOREIGN PATENT DOCUMENTS

| | | | |
|---|---|---|---|
| WO | US98/25231 | 6/1999 | A36B/69/36 |

* cited by examiner

*Primary Examiner*—Mitra Aryanpour
(74) *Attorney, Agent, or Firm*—Michael Best & Friedrich LLP

(57) ABSTRACT

A device and method for teaching a person to swing a baseball bat. The device comprises an elongated shaft having a circular cross-section with a grip handle on one end and a head on to other end. A stop is located where the shaft and handle meet and a slide is mounted on the shaft for movement along the shaft between the head and the stop. A user may place one hand on the handle and the other hand on the slide with the slide at a location spaced from the handle. During swinging, the user moves the slide along the shaft toward and into contact with the stop. Alternatively, a user may grip and swing the trainer as if it were a conventional bat, thereby causing the slide to move from a position adjacent the handle along the shaft until it strikes the head and causes an audible sound.

16 Claims, 4 Drawing Sheets

16
31
12
28
10
24
26
22
17
14
20
18

30
16
31
32
12
28
24
26
17
22
14
20
18
3
3

16
30
28
34
12
24
26
22
14
20
18

4
12
24
4

BATTING SWING TRAINER AND METHOD

This application is a replacement for provisional application Ser. No. 60/246,465 filed Nov. 7, 2000.

BACKGROUND OF THE INVENTION

This invention relates to a device and system for teaching a person the proper way to swing a baseball bat or the like.

Teaching a person the proper technique for swinging a bat can be a difficult task. It can require years of practice and training with an experienced batting coach to perfect the batter's swing. Proper swing technique encompasses proper hand placement and body movement, optimal bat acceleration, and ample power to hit the ball and is of the utmost importance in playing such sports as baseball or softball.

The present invention relates to a swing trainer for teaching a person the proper technique for swinging a bat in order to achieve maximum bat speed and power at impact with a ball. In particular, the swing trainer teaches the user proper body form for swinging a bat and how to use his or her body most effectively when executing a swing.

Bat trainers and warm-up devices of various kinds have been conventionally proposed and used. One category of devices helps batters learn to "break" or "bend" their wrists prior to contacting the ball. The theory is that breaking a batter's wrist ahead of the arms prior to contacting the ball will cause the ball to travel a greater distance when contact with the bat is made. Early bat trainers utilized weighted rings that fit around the hitting end of a standard bat. As the batter swings the bat, the weighted end helps the batter to break his or her wrist, theoretically improving ball distance. U.S. Pat. No. 3,955,816 builds on this by altering the location and size of the weights. Similarly, U.S. Pat. No. 4,555,111 discloses a practice bat that includes a weighted bat head connected to a flexing mid-section. At the beginning of the swing, momentum and the flexing section cause the weighted bat head to lag behind the grip handle. At the end of the swing, momentum and the flexing section cause the weighted end to move ahead of the grip handle. This teaches the batter the proper time to "bend" or "break" the hands and wrists during the swing.

Other devices, such as U.S. Pat. No. 3,246,894, describe a practice bat for visibly recognizing where and when the ball contacts the bat. While the previously described trainers may help batters determine when to move their hands and/or wrists during a swing or to recognize the optimal place a bat should contact the ball, none of the inventions described teaches the batter proper swing technique.

Devices to help improve a batter's swing are available, but these devices typically help the batter to build shoulder and arm muscles used in swinging a bat and improve muscle coordination. Many of these trainers include weights mounted to the shaft of the bat. For example, in U.S. Pat. No. 5,360,209 a batting trainer is disclosed that comprises a handle and a weighted shaft portion attached to a rod extending from the handle. The weighted shaft portion slides away from the grip handle as the batter accelerates the bat during the swing. This device trains the batter to better time acceleration of the bat during the swing by demonstrating the point at which the acceleration of the bat causes the weighted shaft to slide up the rod.

U.S. Pat. No. 4,634,121 discloses a baseball bat swing trainer comprising a baseball bat with a weight that can be mounted at multiple locations on the bat shaft. Changing the position of the weight with respect to the grip handle changes the center of gravity of the bat and alters the effort required by the batter to swing the bat.

Another category of bat swing trainers is illustrated in U.S. Pat. No. 4,399,996, which shows a baseball bat with separate barrel and grip handle portions connected by a spring. The spring is positioned so that the batter's hands will grip the bat on opposite sides of the spring. This arrangement teaches the batter to appreciate and achieve a proper acceleration when the bat impacts the ball.

Swing trainers are also available for use in other sports. For example, the Kallassy Swing Magic™, utilizes a conventional golf club with a pre-formed hand grip, receiving receptacle and moveable hood to teach a person how to properly swing a golf club. In use, the user places one hand on the hand grip and the other hand on the moveable hood, while assuming a conventional golf stance. This posture, the hands close together and the club perpendicular to the mid-line of the body, constitutes the resting position. At the beginning of the swing, the user swings the club backwards while moving the hood along the club shaft toward the club head extending the arm. When the user's arm is fully extended, the user begins to swing the club forward, past the starting position, while moving the hood toward the hand grip. As the user completes the follow through of the swing, the user's hands are close together, similar to the resting position. Repetitious use of this club teaches a golfer proper swing technique. Because a golf club swing is different from a baseball bat swing, the Kallassy Swing Magic™ device does not offer any benefit when teaching a person proper baseball bat swinging technique.

The majority of the swing trainers described only help the batter to determine optimal bat acceleration or simply increase bat resistance by increasing the weight of the bat. A batter can increase muscle mass by increasing the weight of the bat he or she must swing, but still have poor swing technique. Further, obtaining optimal bat acceleration can be achieved even if the batter's swing technique is poor. Therefore, none of the training bats described above is capable of teaching a batter proper swing technique.

Thus, an object of this invention is to provide a swing training tool, which teaches the batter proper swing technique and form. The trainer is adaptable to individual batters and allows for differences in body frame, height and strength. Proper swing technique is taught regardless of the unique characteristics and experience of each batter.

Another object of this invention is to teach a batter the location of his or her body in relation to the bat during a swing. The prior art does not teach a batter the proper way to swing the bat head outwardly, away from the body leading with the butt of the bat. Trainers that simply help a batter to break or bend his or her wrists ignore other parts of the body involved in the proper swing technique of a bat. Further, simply swinging weighted bats does not teach the batter the proper placement of the arms, hands, shoulders and torso throughout a swing of the bat. Outward swinging, while keeping the hands and forearms close to the body, causes the batter to use more of his or her body when executing the swing, thereby achieving more bat speed and power. None of the available swing trainers enable the batter to practice and develop this skill.

One object of this invention is to demonstrate intuitively to the batter the proper form and position of the body while swinging a bat. When the batter swings the trainer, he or she can readily feel where the optimal placement of the hands, arms and body should be during and after the swing.

Repetitious use of the swing trainer promotes muscle memory for proper swing technique, thus allowing the batter to draw on those memories to utilize proper technique when swinging an actual, non-training bat.

The invention also permits the user to check the results of the trainer. After conducting a series of practice swings using the slide training features of the invention, the user may grip the trainer in a manner similar to a conventional bat and use the trainer to check whether the user has achieved an increase in bat speed and power.

A further object of this invention is to provide a self-teaching training tool that a batter can use alone without the need for an experienced training coach. An inexperienced batter can learn how to swing a bat properly and with the correct technique. Similarly, an experienced batter can use the trainer to improve his or her current swing technique or to increase the power behind an already perfected swing. Further, the trainer can be used in many sports requiring the use of a bat or the like, including but not limited to baseball, softball, cricket and the like.

SUMMARY OF THE INVENTION

In general, the swing trainer is a practice bat for use in batting sports to instruct a batter on proper swing technique and form. The trainer is constructed of aluminum or other suitable material and comprises an elongated shaft having a circular cross-section with a grip handle on one end of the shaft and a head on the other end. The shaft preferably has a substantially uniform circumference throughout most of its length. The grip handle resembles that of a conventional baseball bat handle. The shaft and the handle may be composed, for example, of aluminum or a metal alloy. A leather wrap, foam grip or other suitable material covers the handle to give the user a comfortable non-slip surface to hold.

A graspable slide is mounted on the shaft for movement along the shaft between the head and a stop, which is located on the shaft near or adjacent the handle. The slide is covered with a leather wrap, foam grip or other suitable material to match the covering on the handle. The stop can be a one-piece circular member that slides onto the shaft before the handle is attached, or two separate semi-circular portions that are fastened together around the shaft. The stop is made of aluminum or other suitable material. The stop must be mounted on the handle so that will not move or come off during use. A buffer is attached to the end of the slide closest to the handle to prevent pinching of the batter's hand and to provide additional protection against the slide inadvertently leaving the shaft. The buffer is made of plastic, such as nylon or polyethylene, or other suitable material. An upper bumper is preferably attached to the slide to prevent a batter's hands from being pinched between the slide and the bat head. The head serves as a means to prevent the slide from separating from the shaft. The head is generally weighted and can be so constructed as to accommodate different sized weights for interchanging on a single trainer or to accommodate longer shafts. The head is connected to the shaft using an epoxy glue, pin and/or other suitable means. For example, a standard shear, spring or roll method of pinning can be utilized to attach the head, as well as the handle, to the shaft. In an alternative embodiment, the head can be removable and interchangeable with other sized and weighted heads.

The shaft may vary in length and may consist of a hollow tube adapted to receive and hold a variety of weighted rods. Increasing the weight of the rod will increase the resistance experienced by the user, thus increasing the difficulty level of the trainer.

To use the trainer, the user places one hand on the handle of the swing trainer. For a right-handed batter this will be the left hand. The other hand of the user is placed on the slide, which is moved to the top of the shaft in contact with the head. This constitutes the resting or initial position.

At the start of the swing, the batter's hands are spaced apart on the respective grips almost the entire length of the shaft. As the swing progresses, the slide is moved down the shaft toward the handle until it contacts the stop just above the handle. At this point the user's hands will be close together. This movement of the hands during the swing causes the batter to swing the bat head outwardly away from the body while keeping the hands and forearms close to the body. Through repetitious use of the swing trainer, batters will develop muscle memory allowing them to swing a conventional bat more effectively.

As training progresses using the inventive trainer, the user may test his or her progress by placing the slide in its position closest to the handle and gripping the trainer in a manner similar to a conventional bat, i.e., with both hands on the handle. Then, the batter swings the trainer as if it were a conventional bat. During the swing, the slide will move along the shaft from the handle area until it strikes the head. The slide will move up the handle during the swing and strike the head. The sound emitted from this exercise will increase as bat speed and power increases, thereby audibly informing the user of the results of his or her training efforts. As will be appreciated, the invention is applicable to many sports utilizing bats or the like.

DETAILED DESCRIPTION OF THE PREFERRED EMBODIMENT

Figures 1, 2, 3, 4:
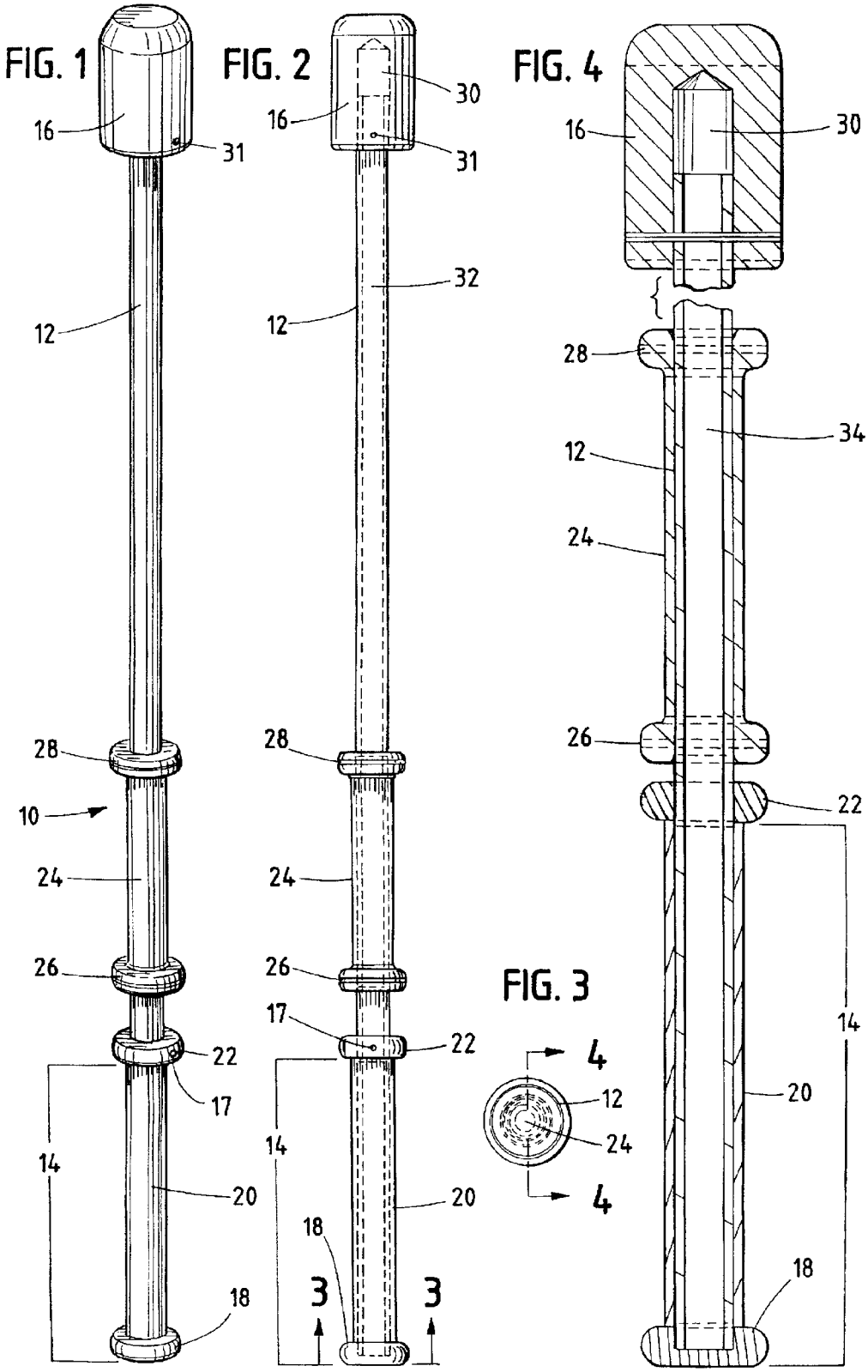
FIG. 1 is a perspective view of one embodiment of this invention.
FIG. 2 is a front elevation view of the embodiment of FIG. 1 with phantom lines depicting a hollow core and bore.
FIG. 3 is a cross-sectional view taken along lines 3—3 of FIG. 2.
FIG. 4 is a cross-sectional view taken along lines 4—4 of FIG. 3.

Referring to FIGS. 1–4, one embodiment of the swing trainer 10 is shown. Specifically, FIG. 1 shows a swing trainer 10 comprising a shaft 12, with a handle 14 on one end and a head 16 on the other. The handle 14 resembles the handle of a conventional baseball bat, having an end cap 18 and a gripping portion 20, which may be covered with a leather or fabric wrap, foam grip, or other suitable material. A stop 22 is attached to the shaft 12 by an epoxy glue, a stand roll, shear or spring pin 17 or other suitable means, adjacent to the handle 14. The shaft 12, end cap 18, and stop 22 can be made of aluminum, plastic or other suitable material.

A graspable slide 24 is mounted to the shaft 12 and moves along the shaft 12 between the stop 22 and the head 16. The slide 24 may contain first and second buffers 26, 28 on each end and, similar to handle 14, is covered with a leather or fabric wrap, foam grip or other suitable material to accommodate at least one hand. Preferably, the slide 24 and handle 14 have the same diameter and the covering for each is the substantially the same. The buffers 26, 28 can be made of plastic, such as nylon, or other suitable material that is capable of withstanding repetitive impacts. The head 16 is weighted and serves as an upper stop for the slide 24. As shown in FIG. 2, the head 16 contains a bore 30 that receives the shaft 12. The head 16 and shaft 12 are permanently connected together using a standard roll, shear or spring pin 31. Alternatively, the head 16 and shaft 12 can be bonded together using an epoxy glue or other suitable attaching means.

Referring to FIGS. 2,3 and 4, the trainer 10 is shown in greater detail. The shaft 12 includes a hollow core 32, which is adapted to accommodate a weighted rod 34 (FIG. 4). The rod 34 may vary in weight and length depending on the needs and demands of the user and the length of the shaft 12.

The trainer 10 is constructed by securing the first and second buffers 26, 28 to the ends of the slide 24 and then mounting the slide 24 onto the shaft 12. Then, stop 22 is slid onto the shaft 12, followed by the attachment of the handle 14 to one end of the shaft 12. The weighted rod 34 is inserted into the core 32 of the shaft 12 and the shaft 12 is then secured by welding, epoxy glue, a pin 31, or other securing means to the head 16. The end cap 18 is then attached to the handle end of shaft 12, by welding, epoxy glue, a pin, or other suitable means.

Figure 7:
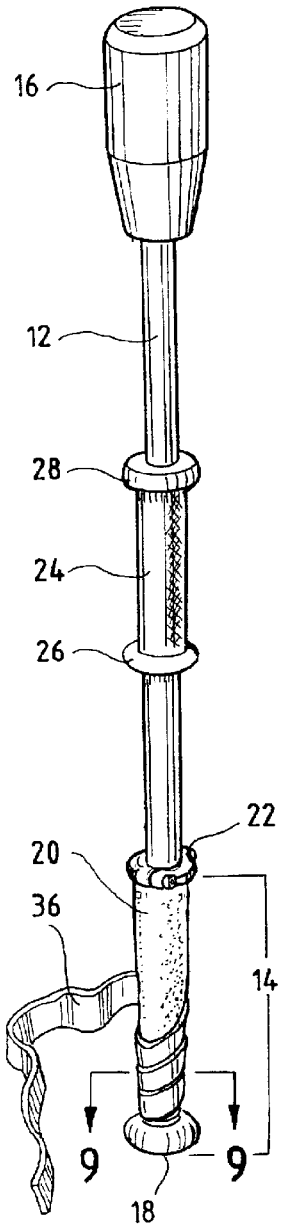
FIG. 7 is a perspective view of another embodiment of this invention.
Figure 8:
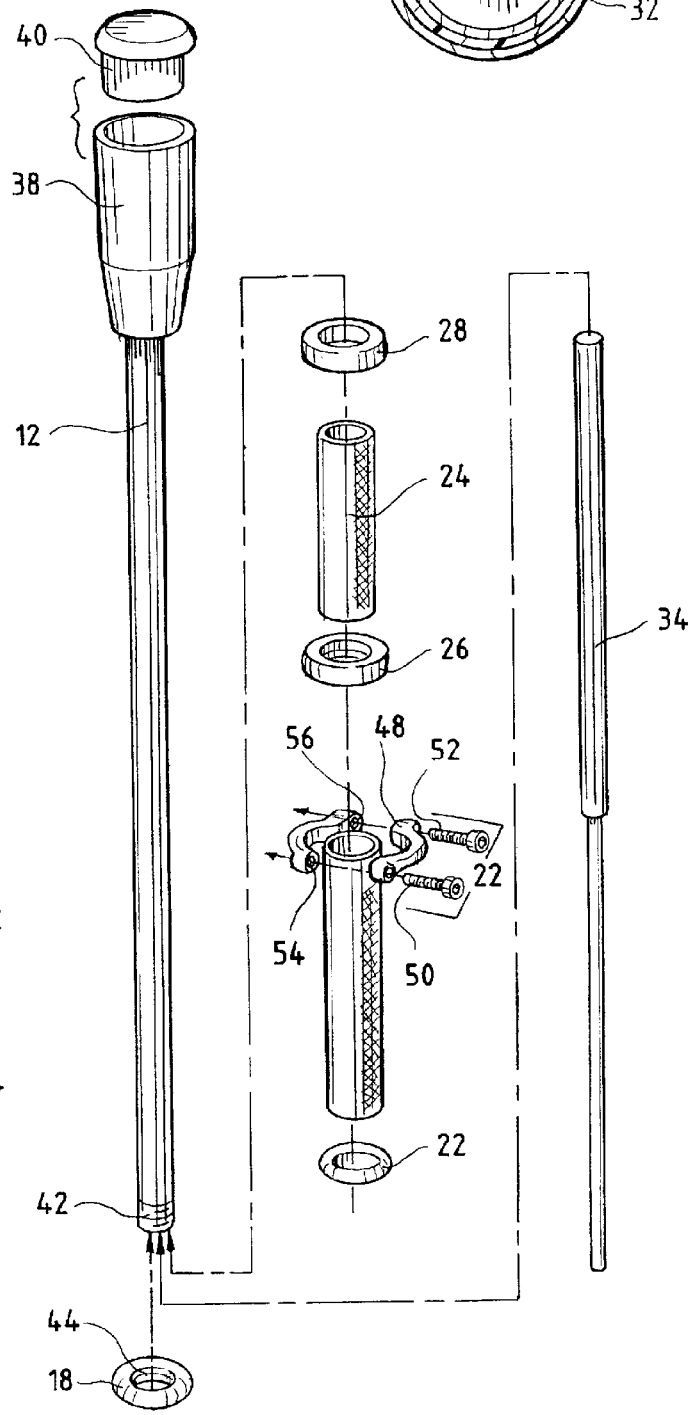
FIG. 8 is an exploded perspective view of the embodiment of FIG. 7.
Figure 9:
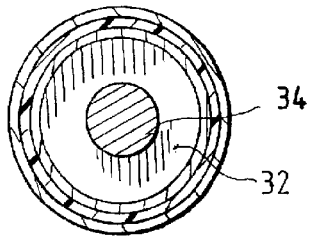
FIG. 9 is a cross-sectional view taken along lines 9—9 of FIG. 7.

Referring to FIGS. 7–9, another embodiment of the trainer 10 is shown. In this embodiment the trainer 10 comprises a shaft 12, with a handle 14 on one end and a head 16 on the other. The handle 14 contains an end cap 18 and a gripping portion 20, which similar to the embodiment of FIGS. 1–4, may be covered with a leather or fabric wrap 36, foam rubber, or other suitable material. A stop 22 is attached to the shaft 12 adjacent to the handle 14. Like the slide of the first embodiment, this slide 24 is mounted on the shaft 12 and moves along the shaft 12 between the stop 22 and the head 16. The slide 24 contains first and second buffers 26, 28 on each end, and can accommodate at least one hand. The head 16 comprises a receptacle 38 and a cap 40 and serves as an upper stop for the slide 24.

As shown in FIGS. 8 and 9, the handle-end of the shaft 12 includes a threaded portion 42 to which the end cap 18 may be attached by means of complementary threads 44 in the end cap 18. A core 32 is provided in the shaft 12 to receive a rod 34, which may vary in weight and length depending on the needs and demands of the user and the length of the shaft 12.

Assembly of this embodiment is similar to the first embodiment, with a few exceptions (see FIG. 8). The first and second buffers 26, 28 are affixed to the ends of the slide 24, which is then mounted onto the shaft 12. Then, the handle 14 is attached to the shaft 12, the weighted rod 34 is inserted into the shaft 12, and the end cap 18 is attached to the end of shaft 12. With the handle 14 in place, the stop 22 is secured to the shaft 12, as shown in FIG. 8. The stop 22 has first and second halves 46 and 48 that surround the shaft 12. The halves 46 and 48 are secured to each other with screws 50, 52 or other means that securely hold the stop 22 on the shaft 12. As shown in FIG. 8, screws 50, 52 are received in threaded portions 54, 56. The cap 40 is then inserted into the receptacle 38 of the head 16 and secured in a way which will not allow it to come off during use of the swing trainer 10.

If desired, the batting trainer of this invention may be made with varying sized handles and grips to accommodate people with varying hand sizes. The head is adapted to receive interchangeable weighted members selected from the group consisting of 12, 16, 20, 26 and 32 ounces. The handle is removable and interchangeable with handles of differing sizes and weights. Various lengths for shafts 12 may also be used, and interchangeable heads 16 and the cap 40 may be made with varying weights to alter the difficulty level of the swing trainer 10.

Figure 5A:
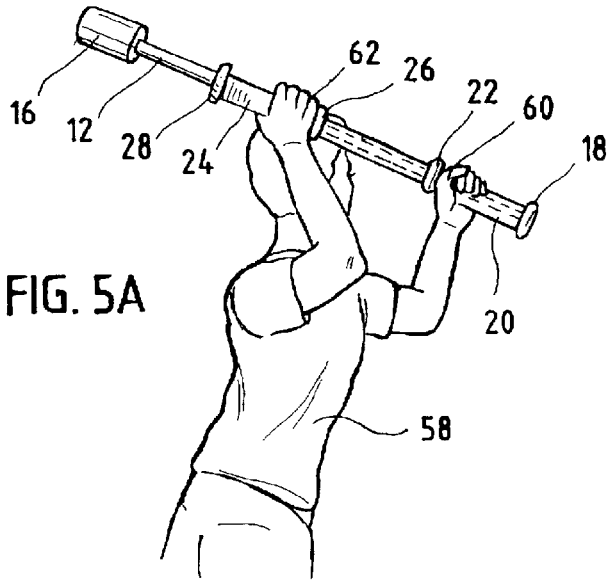
FIGS. 5A, 5B, 5C show a batter swinging the embodiment of FIG. 1 with one hand on the handle and the other hand on the sliding grip, progressing from the starting position (5A), to the mid-point of the swing (5B), and to the completion of the swing (5C)
Figure 5B:
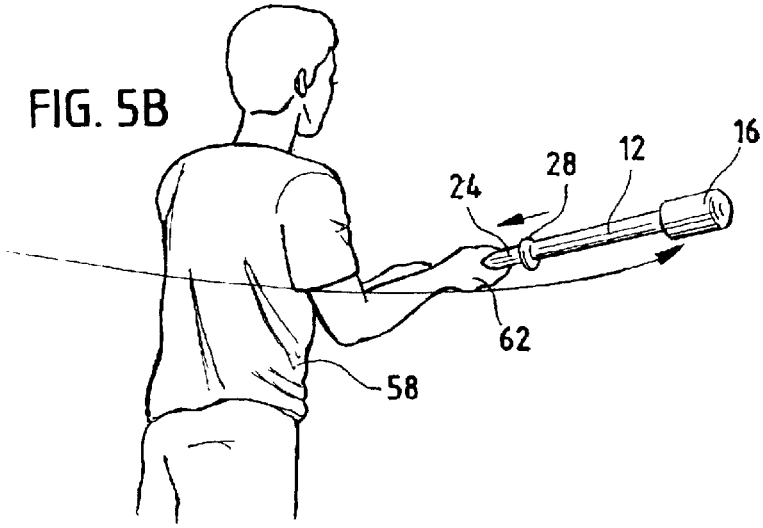
Figure 5C:
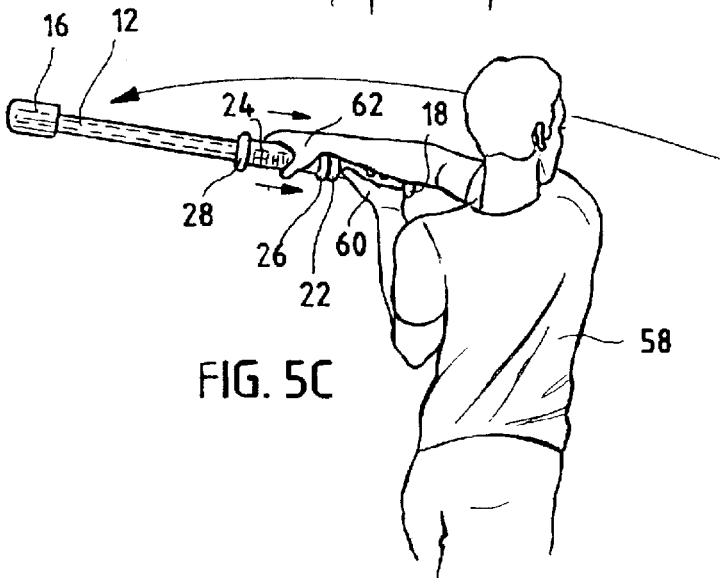

Referring to FIGS. 5A, 5B, and 5C, the typical use of the swing trainer is shown. A person 58 grips the swing trainer 10 with one hand 60 on the handle 14 and the second hand 62 on the slide 24. The hand on the handle 14 preferably is located adjacent the stop 22, thus causing the user to have a "choked-up" position on the handle 14. In the initial or starting position (FIG. 5A), the user moves the slide 24 toward the head 16 until the user reaches a comfortable arm extension or the second buffer 28 comes to rest at the base of the head 16. Thus in the starting position, the user's hands are spaced apart, the spacing varying depending on the user's size and reach.

As the user begins to swing the trainer 10, the slide 24 is moved along the shaft 12 toward the handle 14, as shown in FIG. 5B. This causes the user to swing the bat head 16 outwardly and away from the person's body, while keeping the hands and forearms close to the body. As the user completes the swing (FIG. 5C), the slide 24 is moved further along the shaft 12 until the slide 24 is stopped by the stop 22. Thus, at the completion of the swing, the user's hands 60, 62 are in close proximity, much like on a conventional baseball bat. At this point, the first buffer 26 contacts the stop 22 (FIG. 5C). Using the swing trainer 10 in this way trains the user to swing a conventional bat head outwardly away from the body, while keeping the hands and forearms close to the body, thereby causing the user to use more of his or her body when executing a swing. With repetitive practice swings using the trainer 10, proper form and technique should eventually become sufficiently developed so that the person will duplicate such form and technique when swinging a conventional baseball bat. As the user becomes increasingly proficient using the swing trainer 10, the user can increase the resistance of the trainer 10 by increasing the weight of the rod 40 inside the shaft 12, or both. The handle is removable and interchangeable with handles of differing sizes and weights. As a user's skill and physical requirements change, the size of the handle 14, the length of the shaft 12 or the weight of the bat head 16 can be altered to accommodate the changes.

Figure 6A:
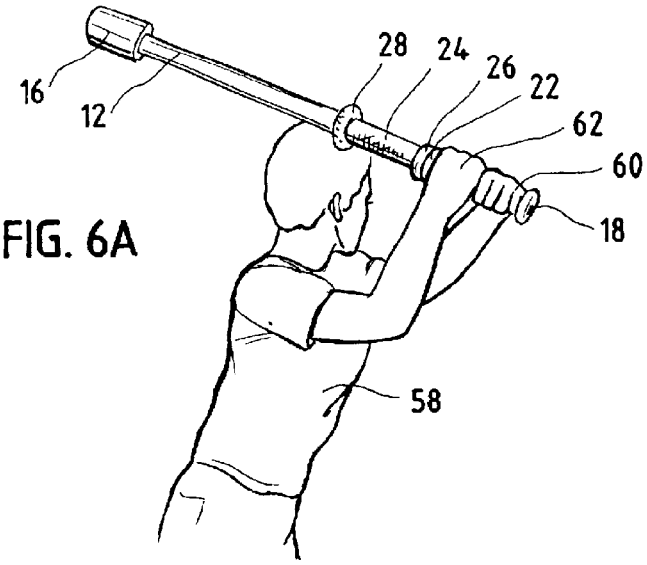
FIGS. 6A, 6B, 6C show a batter swinging the embodiment of FIG. 1 with both hands on the handle, progressing from the starting position (6A), to the mid-point of the swing (6B) where the sliding grip contacts the head, and to the completion of the swing (6C)
Figure 6B:
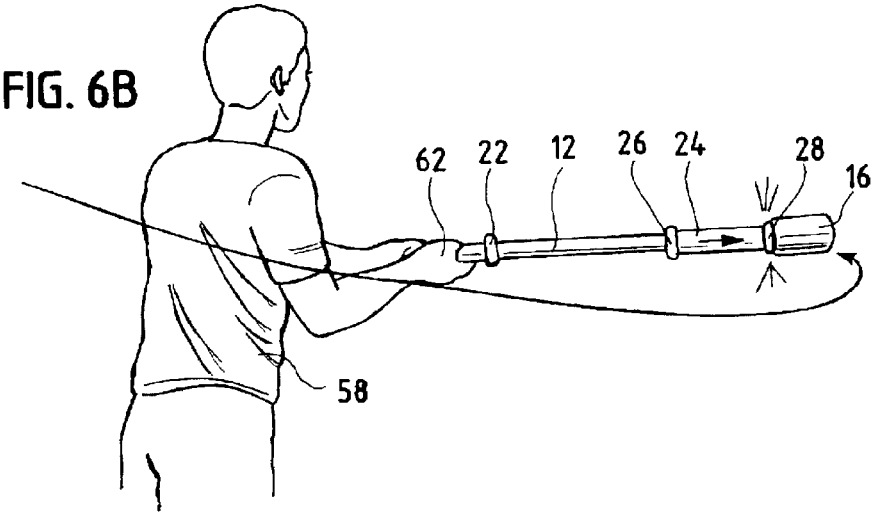
Figure 6C:
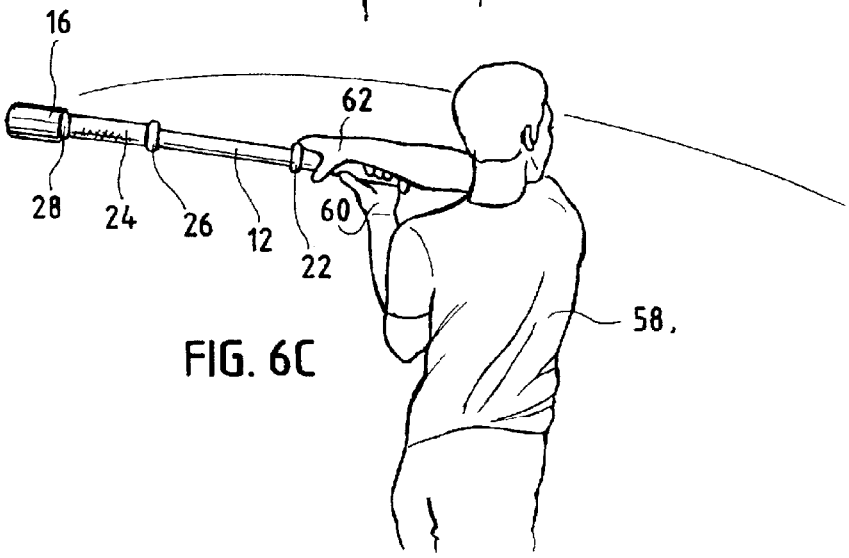

Referring to FIGS. 6A, 6B and 6C, another use of the swing trainer is shown. The purpose of this use is to check the results of the user's training efforts with the inventive trainer. A person 58 grips the swing trainer 10 by placing both hands on the handle 14, as shown in FIG. 6A. In the initial or starting position (FIG. 6A), the user's hands are close together on the handle 14, much like a conventional bat, and the slide 24 is located adjacent the handle and allowed to slide freely along the shaft 12.

As the user begins to swing the trainer 10, the slide 24 moves along the shaft 12 toward the head 16, as shown in FIG. 6B, eventually contacting the head 16 and emitting an audible sound to indicate the force that the user generated by his or her swing. The louder the sound, the greater the swing force. As the user completes the swing (FIG. 6C), the slide 24 will remain adjacent the head 16. Using the trainer 10 in this way, i.e., the check mode, allows the user to determine whether he or she has achieved greater power in the swing of the bat as a result of the use of the inventive trainer in the slide trainer mode (described in FIGS. 5A–5C). As shown in FIGS. 6A–6C, the audible sound would be caused by the impact of the slide 24 against the head 16, but other mechanical or electronic means can be used to emit sounds, such as a bell or the like.

The preceding embodiments are to be regarded as illustrative of the invention, and it will be apparent to those skilled in the art that modifications may be made without departing from the objects of the invention. These modifications are intended to be included within the scope of the invention, as set forth in the appended claims and it is not intended that the invention be otherwise limited.

What is claimed is:

1. A system for teaching a person the proper way to swing a baseball bat to meet a moving ball comprising:

a batting swing trainer including a shaft having first and second ends, a cylindrical handle attached to the first end of the shaft, a cylindrical head having a central bore with the second end of the shaft being fixed in the bore, and a graspable cylindrical slide sized to accommodate all of the fingers of a user's hand for striking the head to produce an audible signal, the slide being mounted on the shaft for axial sliding movement between the handle and the head, a stop attached adjacent the handle, and the graspable slide having first and second ends and including first and second buffers at its first and second ends, the first buffer limiting movement of the graspable slide toward the handle by contacting the stop adjacent the handle and the second buffer limiting movement of the graspable slide toward the head by contacting the head;

wherein the shaft is hollow and a weighted member is secured within the shaft.

2. The system of claim 1 in which the shaft has a substantially uniform circumference.

3. The system of claim 1, wherein the weighted member is a solid rod.

4. A system for teaching a person the proper way to swing a baseball bat to meet a moving ball comprising:

a batting swing trainer including a hollow shaft having first and second ends, a cylindrical handle attached to the first end of the shaft, a cylindrical head having a central bore with the second end of the shaft being fixed in the bore, and a graspable cylindrical slide sized to accommodate all of the fingers of a user's hand for striking the head to produce an audible signal, the slide being mounted on the shaft for axial sliding movement between the handle and the head, a stop attached adjacent the handle, graspable slide having first and second ends and including first and second buffers at its first and second ends, the first buffer limiting movement of the graspable slide toward the handle by contacting the stop adjacent the handle and the second buffer limiting movement of the graspable slide toward the head by contacting the head, and a plurality of rods for securing within the shaft, the rods being of varying weight and length depending on the needs and demands of the user and the length of the shaft.

5. The system of claim 1 including interchangeable heads of differing weights.

6. The system of claim 5, wherein the interchangeable heads have weights selected from the group consisting of 12, 16, 20, 26, and 32 ounces.

7. The system of claim 1 in which the head is adapted to receive a cap and caps of differing weights are provided.

8. The system of claim 1, wherein the handle is covered with a leather wrap, foam grip or other suitable material and the slide is covered with a leather wrap, foam grip or other suitable material to match the covering of the handle.

9. The system of claim 1, wherein the system includes handles of differing sizes and weights and the handles are removable and interchangeable with other handles of differing sizes and weights.

10. The system of claim 1, wherein the stop comprises a ring secured to the shaft.

11. The system of claim 1, wherein the stop comprises first and second portions adapted to fit together to form a ring around the shaft.

12. The system of claim 1, wherein the buffers are rings affixed to the distal ends of the graspable slide.

13. The system of claim 1, wherein the handle and slide have substantially the same diameter.

14. The system of claim 1, wherein the shaft and the handle are constructed substantially of aluminum.

15. The system of claim 1, wherein the shaft and handle are constructed substantially of a metal alloy.

16. The system of claim 1 in which mechanical or electronic means are used to emit the audible signal.

* * * * *